US005971259A

United States Patent [19]

Bacon

[11] Patent Number: 5,971,259

[45] Date of Patent: Oct. 26, 1999

[54] REDUCED DIAMETER DOUBLE SEAM FOR A COMPOSITE CONTAINER

[75] Inventor: John Ellis Bacon, Hartsville, S.C.

[73] Assignee: Sonoco Development, Inc., Hartsville, S.C.

[21] Appl. No.: 09/106,199

[22] Filed: Jun. 26, 1998

[51] Int. Cl.[6] ..... B65D 15/06

[52] U.S. Cl. ..... 229/5.6; 220/619

[58] Field of Search ..... 229/5.6; 220/619

[56] References Cited

U.S. PATENT DOCUMENTS

| | | | |
|---|---|---|---|
| 1,955,745 | 4/1934 | Hurley | 229/5.6 |
| 2,343,550 | 3/1944 | Grove . | |
| 2,633,095 | 3/1953 | Magill et al. . | |
| 2,986,319 | 5/1961 | Bierman et al. . | |
| 3,073,480 | 1/1963 | Henchert . | |
| 3,162,348 | 12/1964 | Galbierz et al. . | |
| 3,178,087 | 4/1965 | Stump . | |
| 3,410,939 | 11/1968 | Driza et al. . | |
| 3,428,239 | 2/1969 | Wannamaker et al. . | |
| 3,580,464 | 5/1971 | Griffith . | |
| 3,715,054 | 2/1973 | Gedde . | |
| 3,933,298 | 1/1976 | Ellerbrock et al. . | |
| 4,144,994 | 3/1979 | Brickeen, Sr. . | |
| 4,163,504 | 8/1979 | Elser . | |
| 4,187,137 | 2/1980 | Beauchamp . | |
| 4,293,090 | 10/1981 | Gardner et al. . | |
| 4,526,290 | 7/1985 | Cerny . | |
| 4,538,758 | 9/1985 | Griffith . | |
| 4,588,621 | 5/1986 | Bunel et al. | 229/5.6 |
| 4,637,543 | 1/1987 | Kücherer . | |
| 4,692,132 | 9/1987 | Zkushima et al. | 220/619 |
| 4,757,936 | 7/1988 | Homma et al. | 220/619 |
| 5,005,728 | 4/1991 | Mazurek et al. . | |
| 5,251,809 | 10/1993 | Drummond et al. . | |
| 5,595,322 | 1/1997 | Kramer . | |

OTHER PUBLICATIONS

Gene Bauer and Robert S. Shea, "Microseam Cans Offer Reduced Dimensions, Solid Performance", Packaging Technology & Engineering, May 1997, pp. 34–38.

Francois Ceccato, "Smoothing out the wrinkles", The Canmaker, Jun. 1997, pp. 67–74.

*Primary Examiner*—Joseph M. Moy

*Attorney, Agent, or Firm*—Alston & Bird LLP

[57] ABSTRACT

A hermetic, composite container including a non-metallic composite container body and a metal end which are joined by a double seam. The double seam has reduced dimensions resulting in significant savings in material. The metal end is formed of a low basis weight metal having a thickness of less than 0.007 inches wherein substantial wrinkling of the metal end nonetheless is avoided.

30 Claims, 4 Drawing Sheets

REDUCED DIAMETER DOUBLE SEAM FOR A COMPOSITE CONTAINER

FIELD OF THE INVENTION

The present invention is directed to a hermetic, composite container having a metal end which is secured to the body of the composite container by a reduced double seam resulting in a substantial reduction of materials within the double seam.

BACKGROUND OF THE INVENTION

Containers, such as composite or metal containers, generally include a container body and metal ends which are joined together by a process referred to as double seaming. A double seam refers to the closure formed by interlocking and compressing an end portion of the metal end which has been preformed with an outer curl and the container body which has been preformed with an outer flange. The resulting double seam has a double lock profile defined by a body hook and a cover hook. The term "cover hook" is used to define that part of the double seam formed from the curl of the metal end. "Body hook" defines the portion of the flange of the container body that is turned down in the formation of the double seam. The first seaming operation of the double seaming process refers to the operation in which the curl of the metal end is tucked under the flange of the container body to form the cover hook and body hook. The second seaming operation refers to the finishing operation wherein the hooks formed in the first operation are rolled tightly against each other. To form a double seam, a rotating seaming chuck and a spring loaded base plate hold the metal end and container body together while first and second operation seaming rolls are cam sequenced in and out to form the double seam.

Such double seaming processes have been employed with metal cans. While the current technology is effective with metal cans, the technology, prior to this invention, has presented new challenges when sealing composite containers. This is due to many difficulties including wrinkling of the metal can end which commonly occurs in the double seaming operation. When such wrinkles (or "teeth") occur in the seam of a metal can, they may simply be ironed out, such as during the second seaming operation, without affecting the integrity of the metal body or the metal end. The resulting cans are therefore effectively sealed and the seam is hermetic. It has been established that the amount of wrinkling is a function of the metal thickness wherein wrinkle formation increases as the metal thickness, i.e., basis weight, decreases.

U.S. Pat. No. 5,595,322 to Kramer is an example of a metal can having a double seam joining the metal end and metal container body. A hermetic seal results because the wrinkles which are formed within the metal end during the curling step or the first seaming operation are ironed out during the second seaming operation. The existence of the wrinkles prior to being ironed out does not affect the integrity of the can body because it, too, is metal.

When this technology is applied to composite cans, however, several problems occur. A composite container may include a combination of compressible foil, paper and plastic wherein the foil layer may form the liner layer. The resulting seam is formed by a seaming process to hermetically seal the composite container body to the metallic end. The problems associated with composite containers are numerous. First, when wrinkling of the metal end occurs in the double seam, it often penetrates the composite can thereby destroying its liner layer rendering the composite can not hermetic. Second, the wrinkles cannot be easily ironed out from composite cans which often include a paper layer.

Double seams have been employed with composite containers wherein the containers are intentionally not hermetic such as are used in U.S. Pat. No. 5,005,728 to Mazurek et al. Wrinkling of the end occurs in these cans but this is desirable because the wrinkles actually assist in rendering these cans not hermetic. It is intended that these cans permit gases to escape, such as may occur during the proofing of packaged dough products. Additionally, wrinkles are encouraged because they assist in gripping and maintaining the end on the composite body of those cans.

SUMMARY OF THE INVENTION

The present invention overcomes the associated disadvantages of double seaming a metal end with a composite container body wherein wrinkling of the metal end occurs by providing a reduced diameter metal end for a hermetic, composite container which at least minimizes, if not avoids, wrinkle formation. Moreover, such is achieved with a reduced basis weight metal even though decreased thicknesses of metal generally increase wrinkle formation. The resulting double seam has reduced dimensions thereby utilizing a lesser amount of the container body within the seam. All of these advantages contribute to the significant savings of the resulting double seam having reduced dimensions.

The double seam profile according to the present invention permits use of smaller diameter metal blanks for forming the metal end resulting in significant cost savings. The significant savings have been estimated to be as much as 25% or more due to the reduced diameter defined by the cut edge of the blank and savings in labor costs. The labor cost savings result from, at least in part, the increased number of blanks that may be formed per sheet of material. The use of lighter basis weight metal, such as metal having a 55 pound basis weight (having a thickness of between 0.0052 inches and 0.0061, with a ±10% tolerance), as opposed to conventional 75 pound basis weight (having about a 0.0086 inch thickness), further contributes to the cost savings resulting in about a 30% reduction in the metal required. The decreased length of composite body within the double seam, i.e. the body hook, also contributes to the significant savings because the body blank is likewise reduced. This, in turn, decreases the compound requirements within the double seam.

The container having the reduced diameter double seam according to the present invention may be produced using, generally, conventional double seaming machines. Additionally, the resulting container sustains abuse and leak tests similar to conventional containers formed by other seaming processes.

The composite container having the reduced seam is produced by the following process. The metal end is formed by a stamp die and the cover is curled with a predetermined profile formed by a curling tool and presented to the end of the body. During the first seaming operation, the body is introduced to the metal end wherein the flange of the container body is reformed into a body hook profile and is interlocked with the cover hook. The second seaming operation compresses the body and cover hooks.

BRIEF DESCRIPTION OF THE DRAWINGS

The foregoing and other objects, features, and advantages of the present invention will be made apparent from the following detailed description of the preferred embodiment of the invention and from the drawings, in which.

DETAILED DESCRIPTION OF THE DRAWINGS

Figure 2:
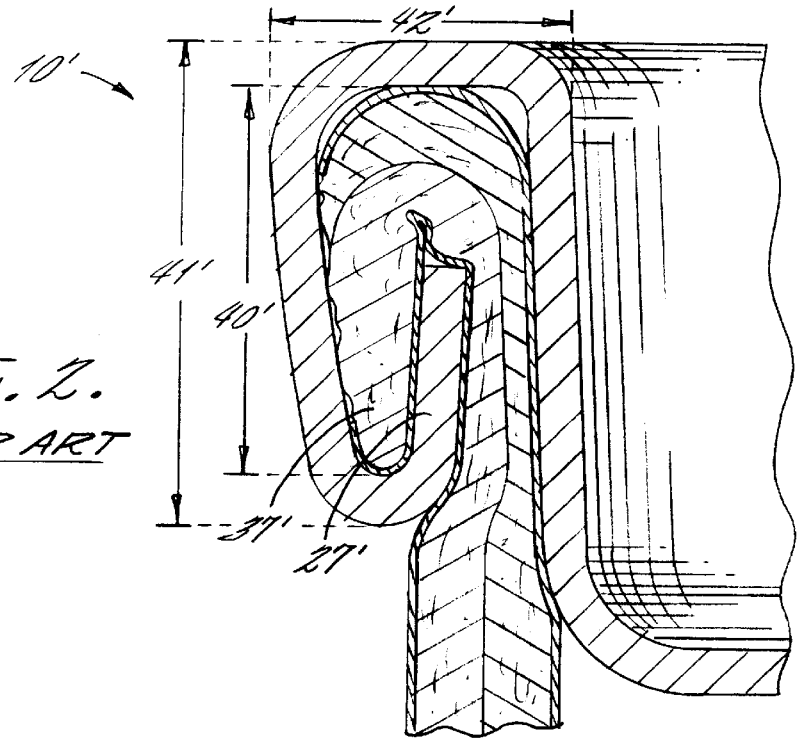
FIG. 2. PRIOR ART
FIG. 2 is an enlarged cross-sectional view of the double seam of a prior art container.

The present invention will now be described more fully in detail with reference to the accompanying drawings, in which a preferred embodiment of the invention is shown. This invention should not, however, be construed as limited to the embodiment set forth herein; rather, it is provided so that this disclosure will be thorough and complete and will fully convey the scope of the invention to those skilled in the art.

The composite container, shown generally at 10, according to the present invention includes a composite container body 11 and a metal end 12. The metal end 12 and the composite container body 11 are joined together by a double seam 14. The double seam 14 includes an end portion 15 of the metal end 12 and an end portion 16 of the container body 11 (best depicted in FIGS. 3 and 4).

As illustrated, the composite container body 11 includes a plurality of layers. It is within the scope of this invention, however for the composite container body to be single-ply and yet formed of a non-metallic material. As used herein, "metallic" refers to a material having a substantial basis weight and which material does not include a compressible foil, paper or plastic layer, for example. Accordingly, the term "non-metallic" refers to composite containers formed, for example, of paperboard or the like and which may include one or more metal foil layers. Composite containers typically include at least one structural body ply and are formed by wrapping a continuous strip of body ply material, such as paperboard, around a mandrel of a desired shape to create a tubular structure. The body ply strip may be spirally wound around the mandrel or passed through a series of forming elements so as to be wrapped in a convolute shape around the mandrel. At the downstream end of the mandrel, the tube is cut into discrete lengths and is then fitted with end caps to form the container.

Tubular containers of this type typically include a liner layer or ply 18 on the inner surface of a paperboard body ply. As illustrated, the body ply includes inner 19 and outer 20 body plies. The liner ply 18 prevents liquids such as juice from leaking out of the container and also prevents liquids from entering the container and possibly contaminating the food product contained therein. Preferably, the liner ply 18 is also resistant to the passage of gasses, so as to prevent odors of the food product in the container from escaping and to prevent atmospheric air from entering the container and spoiling the food product. Thus, the liner ply 18 provides barrier properties and the body ply provides structural properties.

The liner ply 18 is preferably adhered to the inner surface of the inner body ply 19 with a wet adhesive and the overlapping edges of the liner ply are adhered together to ensure that the container 10 is completely sealed. A label ply 21 is preferably adhered to the outer surface of the outer body ply 20 having various indicia printed thereon regarding the product within the container.

Figure 7:
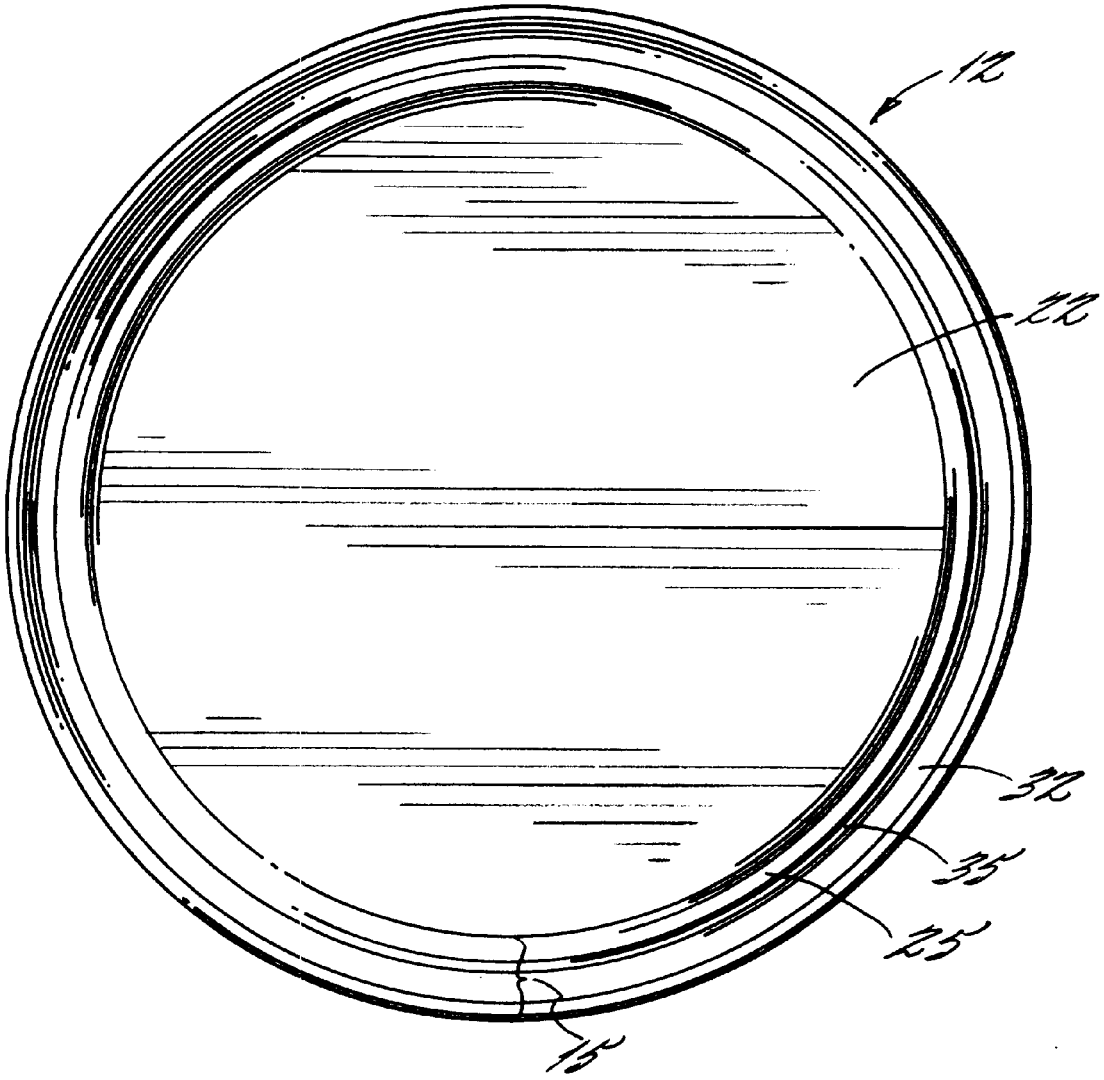
FIG. 7 is a top plan view of the metal end according to the present invention.

The metal end 12 is formed of a lightweight metal which, nonetheless, is capable of being formed into a double seam 14 with a composite container body 11 without causing significant wrinkling of the metal end 12. Accordingly, the liner layer 18 or other layer is not damaged and the hermetic seal is maintained. Preferably, the metal end 12 is formed of a 55 lb. basis weight metal having a thickness of less than 0.007 inches, such as between 0.004 inches and 0.007 inches, for example, about 0.005 to 0.006 inches. The metal end 12 is defined by a center panel portion 22 and an end portion 15 having end hook configuration illustrated in FIGS. 3 and 7. According to the illustrated embodiment, the metal end 12 also includes a reverse panel bead 25.

The end portion 15 of the metal end 12 forming the end hook configuration is defined by a cut end 26, a cover hook 27, a cover hook radius 28, a seaming wall 29, a seaming wall radius 30, a seaming crown 31, a seaming panel radius 32, a chuck wall 33, a chuck wall radius 34, and a chuck panel 35. The chuck panel 35 is adjacent the reverse panel bead 25 in the illustrated embodiment. The end portion 16 of the container of the composite container body 11 is defined by its cut end 36, a body hook 37, a body hook radius 38, and a compression area 39.

Figure 1:
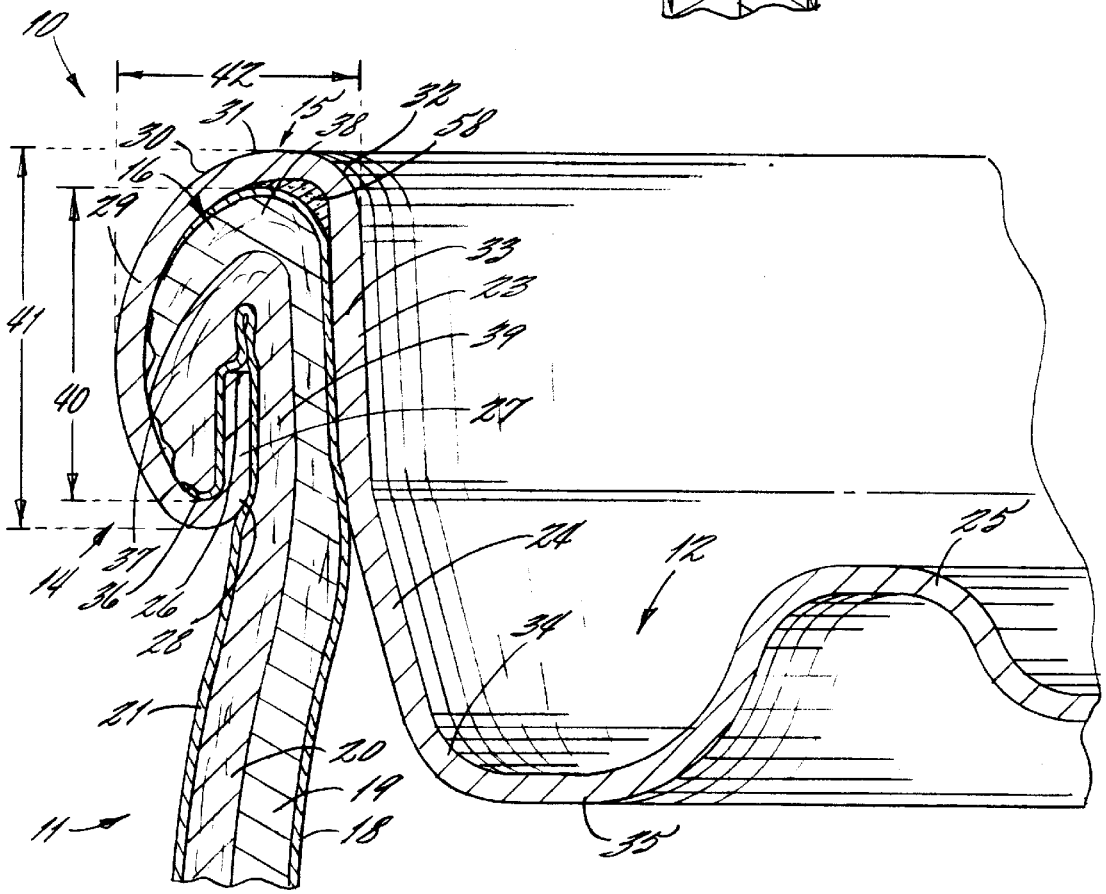
FIG. 1 is an enlarged cross-sectional view of the double seam of the composite container according to the present invention.

The resulting double seam 14 of the composite container 10 as represented by FIG. 1 is formed from a reduced diameter metal end 12 wherein the double seam 14 is formed by a reduced length of the metal end 12 and the container body 11. This is represented by a comparison of FIG. 1 and the composite container 10' which is a prior art container as represented by FIG. 2. The body hook length 40 of the present invention is represented in FIG. 1 and is defined as the vertical distance between the horizontal tangent of the body hook radius 38 and the cut end 36 of the composite container end portion 16. The seam length 41 of the double seam 14 is defined by the vertical distance between the horizontal tangent of the seaming crown 31 of the metal end portion 15 and the horizontal tangent of the cover hook radius 28 of the metal end portion 15. The seam width 42 of the double seam 14 is defined as the horizontal distance defined between the vertical tangent of the seaming wall 29 of the metal end portion 15 and the vertical tangent of the outer surface of the metal end chuck wall 33.

A comparison of the present invention represented in FIG. 1 and the prior art container 10' represented in FIG. 2 illustrates the material savings of the present invention. The seam length 41 of the present invention is less than the seam length 41' of prior art containers 10'. Similarly, the body hook length 40 is less than the body hook length 40' of the prior art. The corresponding seam width 42' of the prior art, as represented by FIG. 2, is significantly greater than the seam width 42 of the present invention. Additionally, the cover hook 27 of the present invention is significantly shorter in length than the cover hook 27' of the prior art. Similarly, the length of the body hook 37 defined between the cut end 36 and the body hook radius 38 of the present invention is significantly less than the corresponding length of the body hook 37' of prior art containers 10'. As set forth above, this results in significant savings in material used to form the double seam 14 thereby permitting a reduced diameter metal end 12 to be utilized as well as a shorter blank which forms the container body 11.

Figure 4:
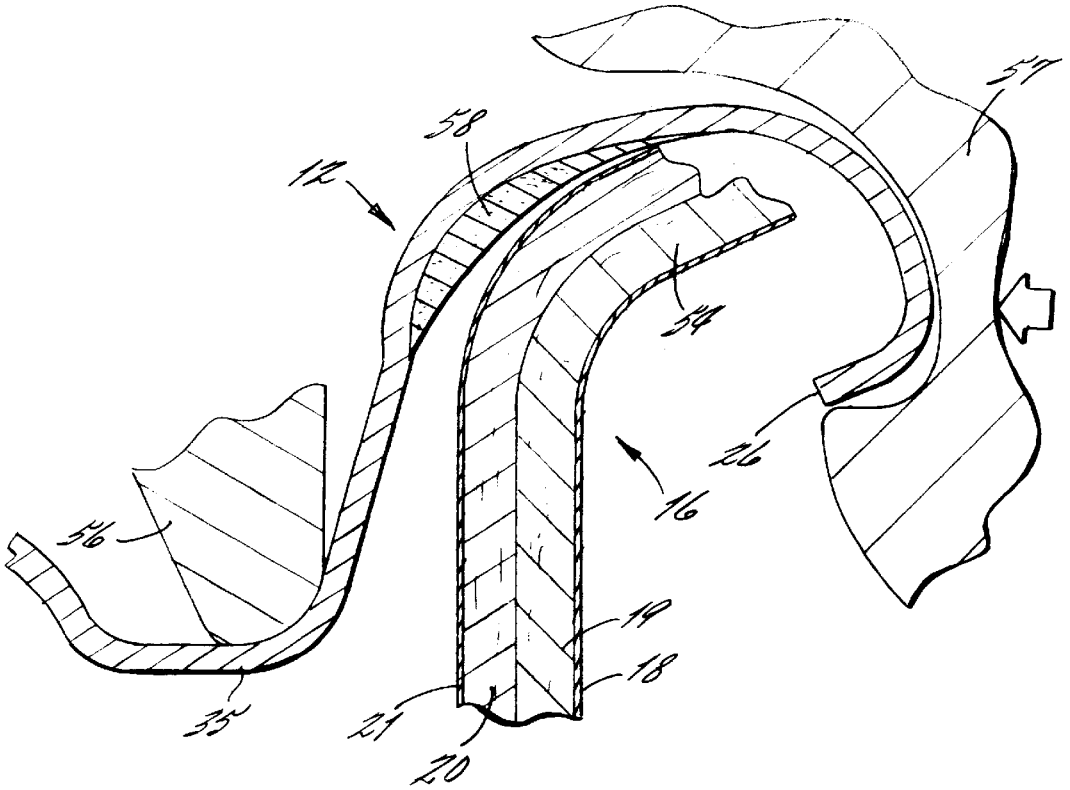
FIG. 4 illustrates the first seaming operation according, to the present invention.

A compound 58 may be used within the double seam 14 of the present invention and is best represented by FIG. 4. The compound 58 is a sealing material consisting of a water or solvent dispersion solution of rubber which is placed in the curl 15 of the metal end 12. The compound 58 aids in effecting a hermetic seal by filling spaces or voids in the double seam 14 used to provide further stability to the double seam 14. The compound utilized may be W. R. Grace #9179E-HV. According to the present invention, because reduced dimensions of the metal end 12 and composite container 10 are employed, a reduced amount of compound 58 may be used. This further contributes to the overall material savings of the present invention.

Figure 3:
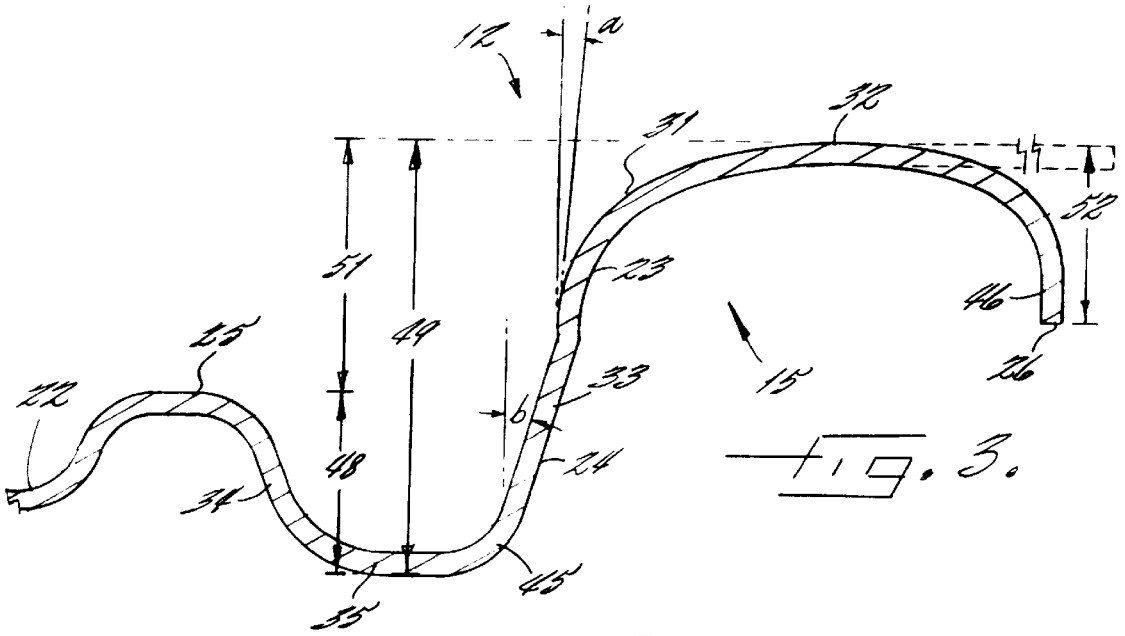
FIG. 3 is a cross-sectional view of the metal end according to the present invention.

Prior to the formation of the double seam 14 of the composite container 10, the reduced diameter metal end 12 is preformed. FIG. 3 represents the preformed metal end 12 according to another aspect of the present invention. The preformed metal end 12 is defined by a center panel portion 22 and an end portion 15 including a reverse panel bead 25. The reverse panel bead 25 is positioned radially inward of and adjacent to the chuck panel radius 34.

As represented in FIG. 3, the chuck wall 33 of the metal end 12 defines two angles a and b to present a double angled or compound chuck wall 33. The chuck wall 33 is defined by a first portion 23 and a second portion 24. The first portion 23 extends at an angle a which is between 2.5° and 8.0°, preferably between 3.5° and 4.5°. The second portion 24 extends at an angle b which is between 10° and 20°, preferably between 15° and 17°. The metal end 12 according to this aspect of the invention also includes a seaming panel radius 31, a seaming crown 32, a metal end curl 46, and cover hook end 26.

The reverse panel bead 25 has a bead height 48 defined as the vertical height between the horizontal tangent of the bead 25 and the chuck panel 35. The metal end 12 also defines a countersink 49 which is defined as the vertical height between a horizontal tangent of the seaming panel crown 32 and the chuck panel 35. The ring depth 51 is defined between the horizontal tangent of the seaming panel crown 32 and the tangent of the reverse panel bead 25. The curl height 52 is defined between the horizontal tangent of the seaming panel crown 32 and the curl end 26. The reverse panel bead 25 and the compound chuck wall 33 contribute to abuse resistance of the composite container 10.

For example, according to an embodiment of the present invention wherein the metal end is formed of a 55 lb. basis weight metal having a thickness less than 0.007 inches, the countersink depth is between 0.100 and 0.150 inches, for example about 0.130 inches. The bead height is between 0.040 and 0.070 inches, for example about 0.050 inches, and the curl height is less than 0.040 and 0.070 inches, for example, less than 0.060 inches.

Figure 5:
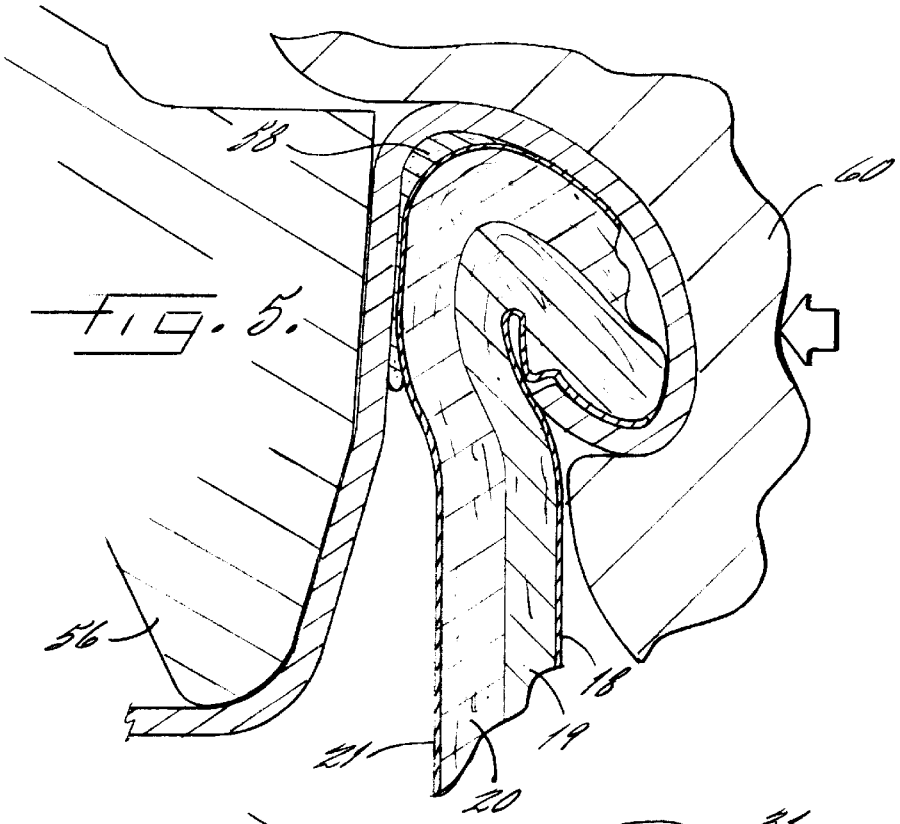
FIG. 5 illustrates an initial view of the second seaming operation.
Figure 6:
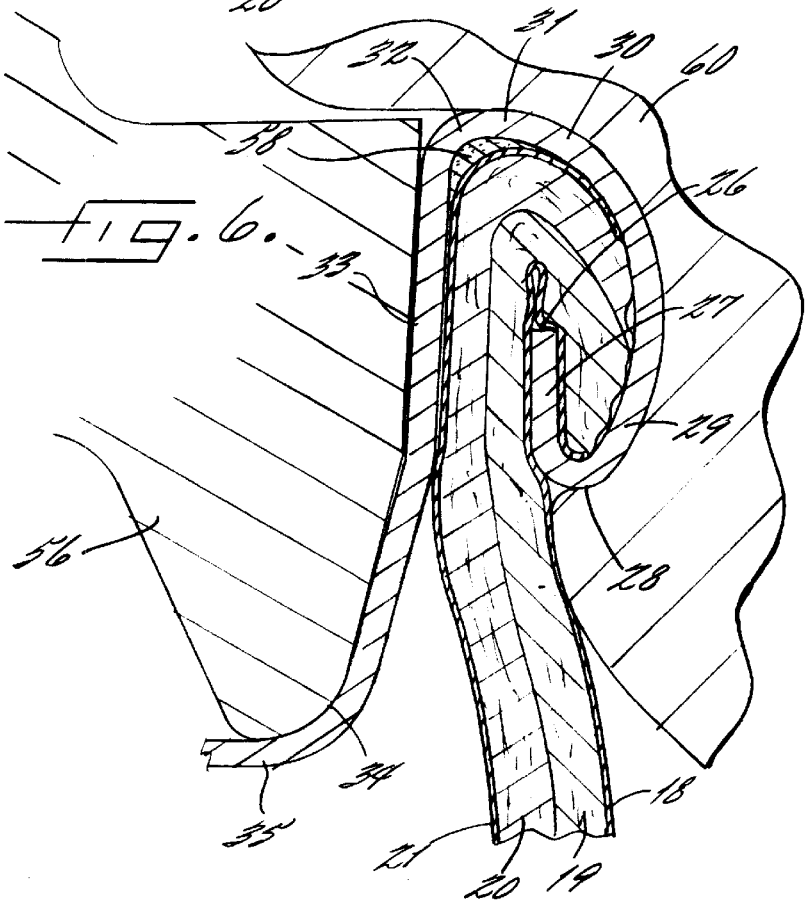
FIG. 6 illustrates the second seaming operation thereof.

The method of forming the composite container 10 having the double seam between the reduced diameter metal end 12 and the composite container body 11 is best represented by FIGS. 4–6. The double seaming operation according to the present invention includes conventional double seaming machines but which utilize seaming chucks having a profile corresponding to the profile of the double seam 14 according to the present invention. As set forth above, the metal end 12 is preformed into the configuration illustrated in FIG. 3. Similarly, the composite container body 11 is also preformed to include a flange 54 as best illustrated in FIG. 4.

The double seaming operation includes a first seaming operation and a second seaming operation. In the first seaming operation, the chuck panel 35 of the metal end 12 is seated against a seaming roll 56 of a closing machine wherein the metal end 12 is urged against a seaming chuck 57. During the first seaming operation the flange 54 of the composite container body 11 is introduced to the preformed metal end 12. A compound 58 may also be introduced. Thereafter, the rotating first operation seaming roll 56 is cammed toward the rotating seaming chuck 57 to initially engage the curl of a metal end 12 to the position illustrated in FIG. 4.

The second seaming operation flattens out the double seam 14 of the composite container. FIG. 5 represents the first position of a second operation seaming chuck 60 which is positioned generally diametrically opposite the first operation seaming chuck 57. The seaming chuck 60 is also cam advanced towards the seaming roll 56 as illustrated in FIG. 5. The parts continue to rotate to complete the double seaming operation as illustrated in FIG. 6. As represented in FIG. 6, substantially no wrinkles are formed during the procedure.

The precise dimensions of the metal end 12 and the resulting double seam 14 will vary depending upon factors including the composite container body 11 thickness and the diameter of the metal end 12 blank selected. Another possible variable is the countersink depth utilized. For instance, the countersink depth may vary depending upon the abuse resistance desired. For instance, the end use of the container such as the contents to be contained, the volume of the container, the strength features required, etc. contribute to the composite container, thickness, and metal end diameter selected. Generalities, however, may be made. For instance, for a composite container 10 having a container body 11 with a wall thickness of between 0.026 and 0.042 inches, such as between 0.028 and 0.032 inches, and disregarding the metal material contributions of the countersink, a cord length of less than 10% of the metal end diameter results. The cord length is the uncompressed or original length of the metal end hook configuration defined between the chuck panel radius 34 and the cut end 36 (as formed). The flange length is defined as the end hook configuration of the metal end 12 if it were straightened, that is, the distance between the chuck wall 33 and the cut end 36 (when straightened) as shown in dotted lines in FIG. 3. According to the present invention, the flange length is less than 7.0% of the metal end diameter. The resulting seam length 41 is less than 0.100 inches, such as about 0.090 inches. The resulting seam width 42 is less than 0.070 inches, such as about 0.060 inches. Regarding the flanged metal end prior to the double seam operation, the reverse panel bead height 48 is between 0.040 and 0.080 inches, the countersink depth 49 is between 0.100 and 0.200 inches, and the curl height 52 is between 0.045 and 0.065 inches.

This is exemplified by the following examples of a 3 inch metal end (referred to as a "300 diameter blank") and a 4 1/16 inch metal end (referred to as a "401 diameter blank"), each having a reduced body wall thickness of less than 0.006 inches and used on a composite container having a thickness of less than 0.032 inches. The terms "300 diameter metal end" and "401 diameter metal end" refer in the industry to the resulting diameter of the container. The ratios following represent a proportion of the specified dimension relative to the diameter of the blank.

| | 3.0" Diameter | 4 1/16" Diameter |
|---|---|---|
| Cord length | <9.83% | <7.42% |
| Flange length | <7% | <4.8% |
| Cover hook length | <1.2% | <0.9% |
| Seam length | <0.090 inches | <0.090 inches |
| Seam width | <0.060 inches | <0.060 inches |
| Seamed countersink depth | <0.150 inches | <0.160 inches |
| The preformed metal end 12 includes the following dimensions: | | |
| Reverse panel bead height | about 0.050 inches | about 0.060 inches |
| Countersink depth | about 0.126 inches | about 0.144 inches |
| Curl height | about 0.055 inches | about 0.056 inches |

Of course, any diameter metal end 12 may be utilized and the above are provided as exemplary metal ends 12. A container having a reduced dimension double seam according to the present invention will nonetheless exhibit the aforementioned general characteristics resulting in significant cost savings.

While particular embodiments of the invention have been described, it will be understood, of course, the invention is not limited thereto since modifications may be made by those skilled in the art, particularly in light of the foregoing teachings. It is therefore, contemplated by the appended claims to cover any such modifications that incorporate those features of these improvements in the true spirit and scope of the invention.

That which is claimed:

1. A hermetic, composite non-metallic container having a reduced diameter double seam formed between a composite body and a metal end having a predetermined diameter, said container comprising said composite body including a plurality of layers including a liner layer and a body ply and said metal end having a thickness of less than 0.007 inches, said metal end having a formed end portion and said composite body having a flanged end wherein said formed end portion and said flanged end are joined by a double seaming operation, wherein said composite body forming said double seam includes a body hook radius and a cut end and said formed end portion forming said double seam includes a chuck wall radius, a seaming panel radius, a cover hook and a cut end, said body hook and said cover hook cooperating to hermetically seal the metal end to the composite container body.

2. A composite container according to claim 1 wherein said formed end portion of said metal end has a cord length measured between the cut end and the chuck wall radius of less than 10.0% of said predetermined diameter of said metal end.

3. A composite container according to claim 1 wherein said formed end portion has a flange length defined between said cut end and said chuck wall of less than 8.0% of said predetermined diameter.

4. A composite container according to claim 3 wherein said end flange length is less than 7.0% of said predetermined diameter.

5. A composite container according to claim 1 wherein said liner layer is liquid and gas impermeable.

6. A composite container according to claim 1 wherein said plurality of layers includes at least said liner layer and an additional body ply including paper as a composition thereof.

7. A composite container according to claim 6 wherein said plurality of layers further includes an outer layer.

8. A composite container according to claim 1 wherein said metal end has a thickness less than about 0.006 inches.

9. A composite container according to claim 8 wherein said metal end has a thickness less than about 0.005 inches.

10. A composite container according to claim 1 wherein said composite body forming said double seam is defined by a body wall, a compression area, said body hook radius, a body hook, and said cut end.

11. A composite container according to claim 1 wherein said formed end portion forming said double seam is defined by a chuck panel, said chuck wall radius, a chuck wall, said seaming panel radius, a seaming wall, a cover hook radius, said cover hook, and said cut end.

12. A reduced diameter double seam formed between a metal end and a non-metallic composite container body, said double seam comprising: said metal end having a predetermined diameter, a thickness of between about 0.004 and 0.007 inches and a formed end portion and said composite container body having a flanged end, said formed end portion and said flanged end being joined by a double seaming operation, said container body of said double seam including a body wall, a compression area, a body hook radius, a body hook and a cut end and said formed end portion of said double seam includes a chuck wall radius, a chuck wall, a cover hook radius, and a cut end and having a cord length of less than about 10% of said predetermined end diameter wherein said body hook and said cover hook cooperate to hermetically seal the metal end to the composite container body.

13. A reduced diameter double seam according to claim 12 wherein said formed end portion of said double seam is defined by a chuck panel, said chuck wall radius, said chuck wall, a seaming panel radius, a seaming crown, a seaming wall radius, a seaming wall, said cover hook radius, a cover hook, and said cut end.

14. A reduced diameter double seam according to claim 12 wherein said cord length is less than about 8%.

15. A reduced diameter double seam according to claim 12 wherein said container body has a thickness of between 0.028 and 0.032 inches.

16. A reduced diameter double seam according to claim 12 wherein said formed end portion of said metal end has a flange length measured between the cut end and the chuck wall radius of less than 8.0% of said predetermined end diameter.

17. A reduced diameter double seam according to claim 16 wherein said formed end portion of said container end has a flange length measured between the cut end and the chuck wall radius of less than 7.0% of said predetermined end diameter.

18. A reduced diameter double seam according to claim 12 wherein said chuck wall defines a compound chuck wall angle.

19. A reduced diameter double seam according to claim 18 wherein said compound angle is defined by a first chuck wall portion extending at a first angle of 2.5°–8° and a second chuck wall portion extending at a second angle of 10°–20°.

20. A reduced diameter double seam according to claim 19 wherein said first angle is about 3.5°–4.5° and said second angle is between 15°–17°.

21. A reduced diameter metal end for a composite container which is formed in a double seam without substantial wrinkle formation and which has a predetermined diameter, said metal end comprising: a thickness of less than about 0.007 inches for use with a composite container body, a center panel portion having an end hook configuration about its perimeter, said end hook configuration being defined by a chuck panel, a chuck wall radius, a chuck wall defining a chuck wall angle, a seaming panel radius, a seaming panel crown, a curl and a cut end, and a reverse panel bead, said end hook configuration having a cord length of less than about 10% of the metal end diameter.

22. A reduced diameter metal end according to claim 21 wherein said metal end defines a countersink of between about 0.100 and 0.250 inches.

23. A reduced diameter metal end according to claim 21 wherein said reverse panel bead has a bead height of between about 0.040 and 0.070 inches.

24. A reduced diameter metal end according to claim 22 wherein said countersink is between about 0.100 and 0.150 inches.

25. A reduced diameter metal end according to claim 24 wherein said countersink is about 0.013 inches.

26. A reduced diameter metal end according to claim 21 wherein said seaming panel crown and curl define a curl height of less than about 0.070 inches.

27. A reduced diameter metal end according to claim 26 wherein said seaming panel crown and curl define a curl height of less than about 0.060 inches.

28. A reduced diameter metal end according to claim 21 wherein said end hook configuration has a flange length defined between said curl end and said chuck wall of less than about 8.0% of said metal end diameter.

29. A reduced diameter metal end according to claim 26 wherein said flange length is less than about 7.0% of said metal end diameter.

30. A reduced diameter metal end according to claim 26 wherein said flange length is less than about 5.0% of said metal end diameter.

* * * * *